United States Patent [19]

Wainwright

[11] Patent Number: 4,537,146

[45] Date of Patent: Aug. 27, 1985

[54] AEROFOILS

[76] Inventor: Barry Wainwright, Help Cottage, Dundry, Bristol, BS18 8JF, England

[21] Appl. No.: 434,922

[22] Filed: Oct. 18, 1982

[51] Int. Cl.[3] ..... B63H 9/04

[52] U.S. Cl. ..... 114/103

[58] Field of Search ..... 114/102, 103, 39, 353, 114/201 R; 244/214–219

[56] References Cited

U.S. PATENT DOCUMENTS

| | | | |
|---|---|---|---|
| 1,462,800 | 7/1923 | Clemmer | 114/353 |
| 3,524,610 | 8/1970 | Alvarez-Caldern | 244/214 |
| 3,580,203 | 5/1971 | Martin | 114/102 |
| 3,934,533 | 1/1976 | Wainwright | 114/103 |
| 4,386,574 | 1/1983 | Ridlland | 114/103 |

FOREIGN PATENT DOCUMENTS

| | | | |
|---|---|---|---|
| 1410175 | 10/1975 | United Kingdom | 114/103 |
| 2088308 | 6/1982 | United Kingdom | 114/103 |

*Primary Examiner*—Jesûs D. Sotelo

*Attorney, Agent, or Firm*—Cushman, Darby & Cushman

[57] ABSTRACT

A reversible aerofoil comprises a central panel (10) with lateral panels (12A,12B) hinged to opposite edges. The lateral panels can be hinged so that either one overlies the central panel while the other is extended, thereby producing alternative mirror-image aerofoils. The lateral panels can be hinged so that they both overlie the central panel, thereby producing a stowed configuration. The shape of the panels is such that in the stowed configuration the profile of the outside surfaces of the lateral flaps match that of the central panel, thereby allowing a cross-section to be produced which edge-on is substantially symmetrical, preferably elliptical, thereby producing a low-drag aerodynamically stable stowed configuration.

3 Claims, 1 Drawing Figure

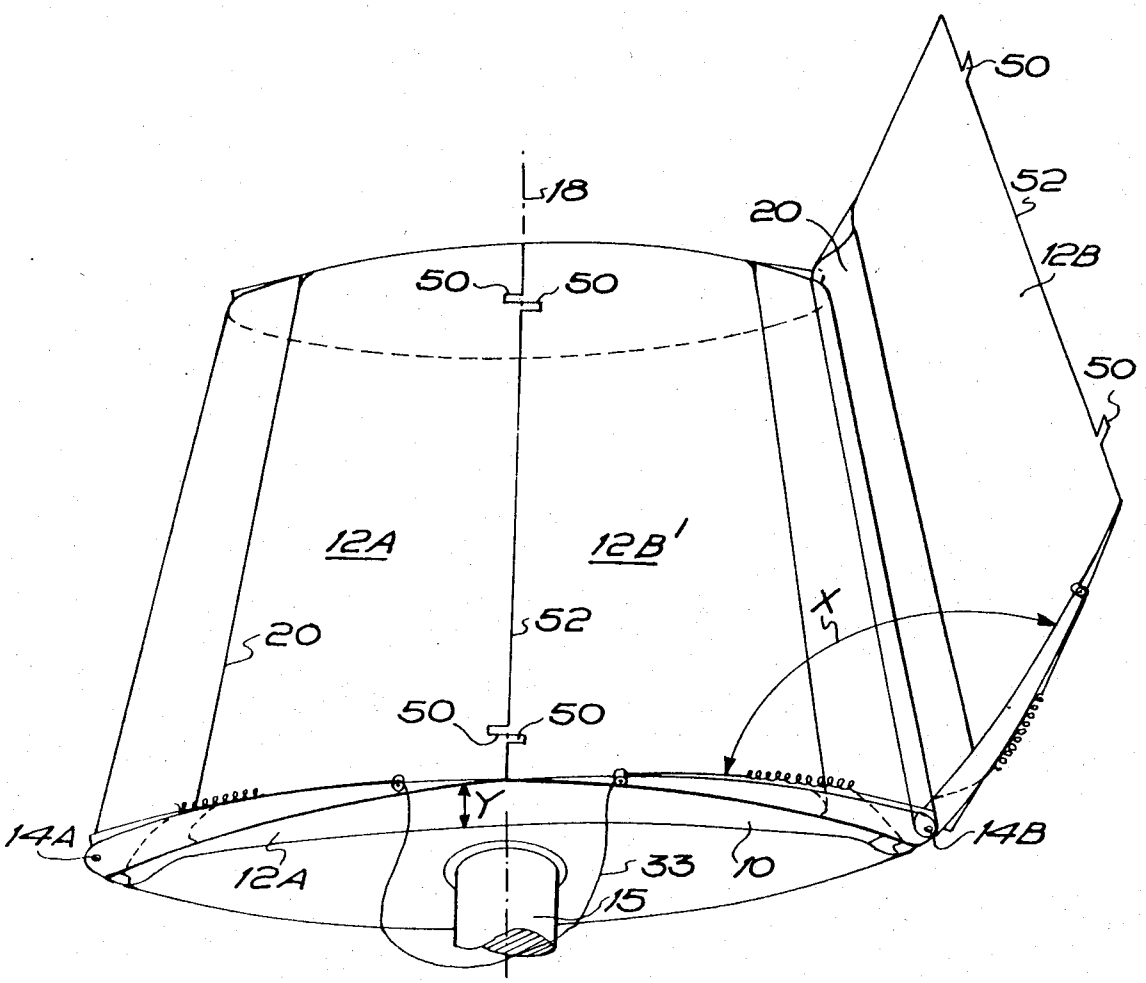
50
52
12B
50
14B
20
X
10
12B'
33
15
18
50
52
50
Y
50
50
12A
20
12A
14A

AEROFOILS

This invention relates to aerofoils and is especially applicable to a rigid sail for sailing craft. It is an improvement in aerofoils described in my U.K. Patent Specification No. 1410175 and U.K. Patent publication No. 2088308.

In my U.K. Patent Specification No. 1410175 I described in relation to FIGS. 1 to 3 of the drawings an aerofoil, comprising a central panel and lateral panels hingedly connected at each side thereof, the central panel being arranged for rotation about a central longitudinal axis, the lateral panels on the two sides being of similar cross-section and the central panel being of symmetrical cross-section about a median plane passing through said central axis at right-angles to the panel, the cross-sections of the panels being such that either one of the lateral panels can be folded inwardly to lie against the central panel, the combined panels thereby forming a non-symmetrical aerofoil in cross-section, the mirror image of which can be provided by alternatively folding in the other lateral panel, the aerofoil thus formed being adjustable relative to the prevailing air flow by rotation about said axis.

If it is desired to stow the sail, for example when in port, or when moving under power without using the sails, or in extremely high wind conditions, both lateral panels can be folded against the central panel, thereby forming a cross-section which is symmetrical about a transverse median plane. However the curvature of the resulting section is substantially different on opposite surfaces, and this can lead to various kinds of instability under high wind conditions.

According to the present invention the lateral panels, when both folded inwards, provide an external surface whose profile substantially matches that of the external surface of the central panel, thereby producing a stowed configuration for the aerofoil which has a substantially symmetrical cross-section edge-on.

The accompanying drawing shows a diagrammatic perspective view of an aerofoil sail, with two different flap positions.

Referring to the drawing the aerofoil sail comprises a central panel 10 and lateral panels 12A,12B hingedly connected at each side of the central panel for hinging about respective axes 14A,14B. The central panel has a central longitudinal spar which, when the sail is fitted to a sailing craft, is journalled, for example on shaft 15 to the body of the craft for rotation about a longitudinal central axis 18. The central panel is of symmetrical cross-section about a transverse median plane passing through the central axis 18. The lateral panels are of similar cross-section to each other, and are designed in conjunction with the cross-section of the central panel so that either one of the lateral panels can be folded inwardly to lie against the central panel, with the other lateral panel extended, thereby forming alternative non-symmetrical aerofoils. The lateral panels are provided with slots 20 for improved aerodynamic performance, but they need not necessarily be slotted. The extended lateral panel can be hinged into varying angles of incidence, according to the prevailing wind conditions and degree of lift required. The drawing shows the lateral panel 12B at about 65° to the plane of the main panel, thereby providing a high lift aerofoil section useful in light wind conditions. As indicated by the arrow X, it can be hinged further out, to any position up to a fully extended condition, at which it is at about 20° to the plane of the main panel, suitable for higher wind speed conditions, or it can be hinged further in to lie over the central panel 10 as indicated at 12B' in a similar fashion to the other lateral panel.

The lateral panels 12A,12B of the aerofoil can thus be stowed merely by folding both of them inwards to lie over the central panel 10. Each lateral panel 12A,12B is provided with fingers 50 on its free longitudinal edge 52. Respective fingers on the two lateral panels are slightly offset from each other in the longitudinal direction, so they do not foul each other.

To stow the lateral panels 12A,12B they are folded inwardly until their edges 52 meet. The width of the lateral panels and their profile is such that when this happens, they define an elliptical external cross-section in conjunction with the central panel 10. The drag caused by the sail in this elliptical position is relatively low and it is quite stable in high winds.

In bringing them to the elliptical position, each lateral panel is manoeuvred so that its free edge 52 lies under the fingers 50 of the other. Thus the fingers 50 co-operate to help lock the lateral panels in the elliptical position, holding the edges 52 together. Magnetically operated pins can be released to interlock the fingers and hold the lateral panels in this condition.

It will be observed that in this position the meeting edges of the lateral panels 12A,B are spaced somewhat from the central panel 10, as indicated by the arrow Y. This is in contrast with the arrangement described in my U.K. Patent Specification No. 1410175 where they lie against the central panel, and this feature of the present invention enables a symmetrical, preferably substantially elliptical, cross-section to be achieved.

I claim:

1. An aerofoil, comprising a central panel and lateral panels hingedly connected at each side thereof, the central panel being arranged for rotation about a central longitudinal axis, the lateral panels on the two sides being of similar cross-section and the central panel being of symmetrical cross-section about a median plane passing through said central axis at right-angles to the panel, the cross-sections of the panels being such that either one of the lateral panels can be folded inwardly to lie against the central panel leaving the other lateral panel extended, the combined panels thereby forming a non-symmetrical aerofoil in cross-section, the mirror-image of which can be provided by alternatively folding the other lateral panel, the aerofoil thus formed being adjustable relative to the prevailing air flow by rotation about said axis, the lateral panels also being foldable inwards together to meet edge-to-edge in a stowed configuration for the aerofoil wherein the meeting edges of the lateral panels in the stowed configuration are spaced from the surface of the central panel and the lateral panels provide an external surface whose profile substantially matches that of the external surface of the central panel.

2. An aerofoil according to claim 1 wherein the stowed cross-section is substantially elliptical in form.

3. An aerofoil according to claim 1 wherein the meeting edges of the lateral panels are provided with mutually offset projections each of which overlies the trailing edge of the lateral panel in the stowed configuration whereby the projections lock the panels edge-to-edge.

* * * * *